US005472090A

United States Patent [19]

Sutherland

[11] Patent Number: 5,472,090

[45] Date of Patent: Dec. 5, 1995

[54] WRAP-AROUND CARRIER WITH PARTIAL END PANELS

[75] Inventor: Robert L. Sutherland, Kennesaw, Ga.

[73] Assignee: Riverwood International Corporation, Atlanta, Ga.

[21] Appl. No.: 292,504

[22] Filed: Aug. 18, 1994

[51] Int. Cl.[6] ..... B65D 71/36

[52] U.S. Cl. ..... 206/427; 206/140

[58] Field of Search ..... 206/140, 152, 206/153, 427–435

[56] References Cited

U.S. PATENT DOCUMENTS

| | | | |
|---|---|---|---|
| Re. 32,956 | 6/1989 | Schuster | 206/435 |
| 3,963,121 | 6/1976 | Kipp | 206/434 |
| 4,216,861 | 8/1980 | Oliff | 206/427 |
| 4,295,598 | 10/1981 | Calvert | 206/428 |
| 4,440,340 | 4/1984 | Bakx | 206/427 |
| 4,732,316 | 3/1988 | Oliff et al. | 206/427 |
| 5,000,313 | 2/1991 | Oliff | 206/434 |
| 5,060,792 | 10/1991 | Oliff | 206/434 |
| 5,328,030 | 7/1994 | Sutherland | 206/434 |
| 5,360,104 | 11/1994 | Sutherland | 206/427 |
| 5,360,113 | 11/1994 | Harris | 206/427 |

*Primary Examiner*—Jimmy G. Foster

[57] ABSTRACT

A wrap-around carrier with partial end panels. The partial end panels are formed by end panel flaps connected to the bottom panel flaps of the carrier and in combination with overlying end closure flaps connected to the side panels of the carrier. A gusset panel connects adjacent end panel flaps and end closure flaps. Upper corner webs may also be provided to form a barrier for restraining outward movement of the upper portion of packaged articles at the ends of the carrier.

16 Claims, 3 Drawing Sheets

WRAP-AROUND CARRIER WITH PARTIAL END PANELS

FIELD OF THE INVENTION

This invention relates to wrap-around article carriers. More particularly, it relates to wrap-around carriers which include partial end panels capable of blocking the price code printed on the end articles.

BACKGROUND OF THE INVENTION

Certain types of articles, such as food or beverage containers, are commonly sold either as individual units or in a multi-container carton. Each article is normally marked with a pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred instead to provide wrap-around carriers with partial end panels of a size sufficient to cover the pricing code on the end articles in the package. Such a design would require less stock than a fully enclosed carrier and be would correspondingly more economical to produce. Partial end panels designed to cover pricing codes located near the bottom of the article would require only a short panel extending up from the bottom panel. A problem facing such a design, however, arises in connection with wrap-around carriers whose bottom panel is formed from connected bottom panel flaps. The partial end panel must not interfere with the formation of the bottom panel nor with the ability to wrap the blank from which the carrier is formed tightly wrapped about the articles being packaged. In addition, the partial end panel should be capable of assisting in holding the end articles in place to prevent them from falling out of the carrier. This is especially difficult when the articles are curved, such as cylindrical beverage cans.

BRIEF SUMMARY OF THE INVENTION

In the wrap-around carrier of the invention an end panel flap is foldably connected to each end of the bottom panel and end closure flaps extending from opposite ends of each side panel overlie portions of the associated end panel flaps. Each end closure flap is connected to an associated end panel flap by a gusset panel which lies between the end closure flap and the associated end panel flap. In a preferred arrangement the bottom panel is comprised of two connected bottom panel flaps extending from the side panels, and the end panel flaps are comprised of separate flaps foldably connected to each of the bottom panel flaps.

The end closure flaps extend around adjacent portions of the end articles in the carrier and, in the case of a carrier containing curved articles, such as cylindrical cans, the flaps conform to the curvature of the articles, holding the articles against outward movement. The dimensions of the end closure flaps are such that the flaps cover the pricing code on the individual end articles in the carrier.

To provide additional protection against outward movement of the articles the carrier may include corner webs, each corner web extending from an end edge of the top panel to an associated side panel.

Fabrication of the carrier is simplified by the gusset panel arrangement which causes the end closure flaps to automatically move into position upon the end panel flaps being folded into place. Moreover, the carrier is economical to produce since the carrier blank requires only a minimum of material.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
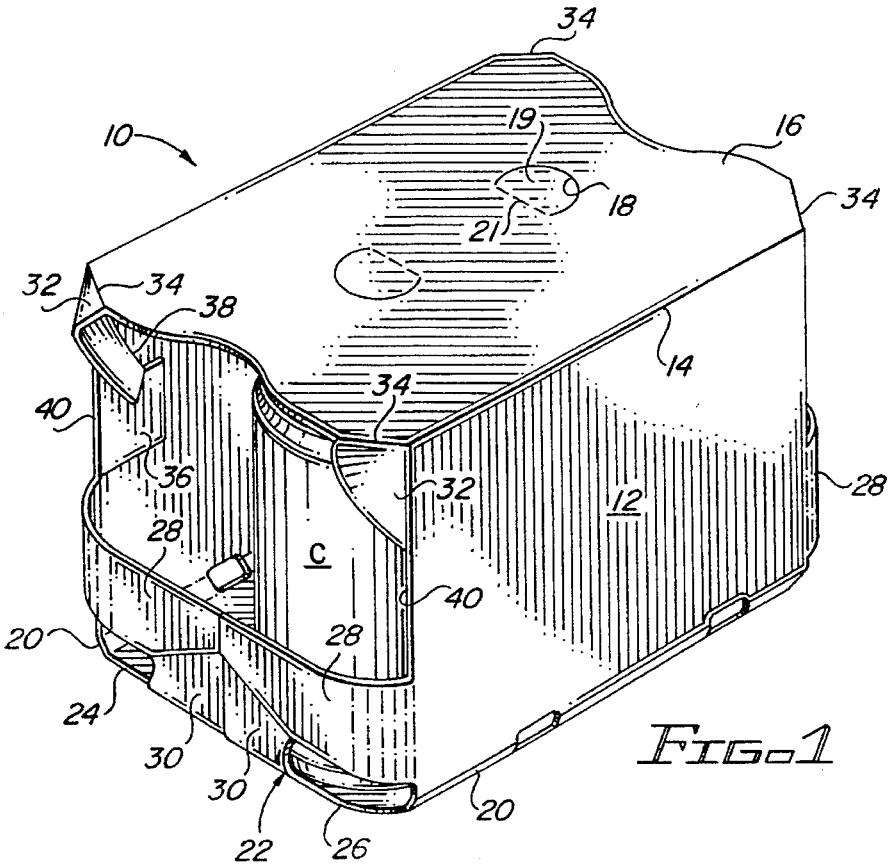
FIG. 1 is a pictorial view of the carrier of the invention, represented as being designed to hold six beverage cans, one of which has been omitted in order to view the interior of the end portion of the carrier.
Figure 2:
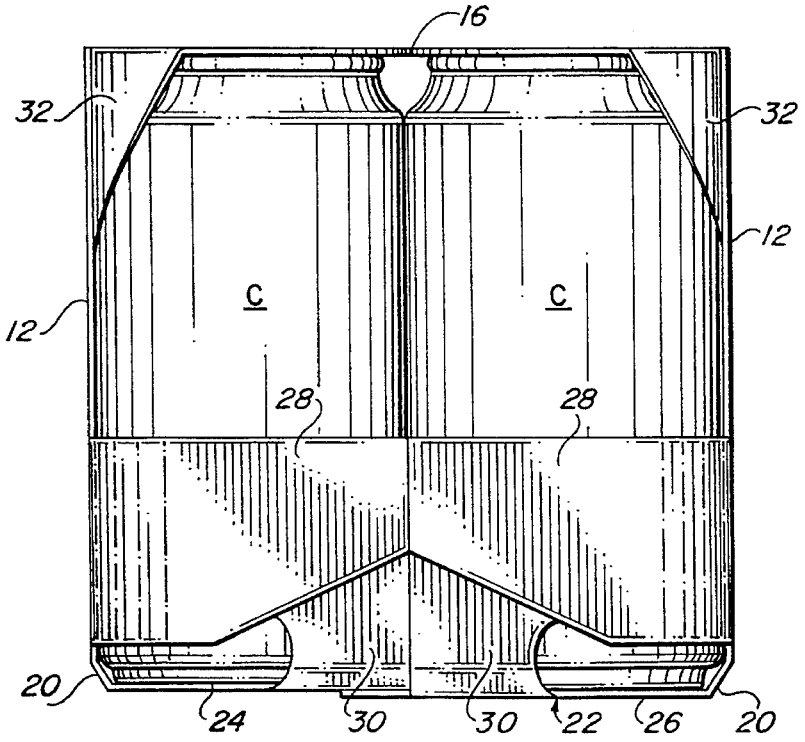
FIG. 2 is an end view of the carrier, with all cans in place.

Referring to FIGS. 1 and 2, a wrap-around carrier 10 is comprised of opposite side panels 12 connected by fold lines 14 to top panel 16. The top panel includes finger holes 18 which may be covered by tabs 19 connected to the top panel by fold lines 21. Short bevel panels 20 connect the side panels to a bottom panel 22 formed from overlapping bottom panel flaps 24 and 26. The bevel panels, which generally follow the contour of the lower portion of adjacent beverage cans C, may be considered part of the side panels in connection with the description and claiming of the invention.

Each end of the carrier includes end closure flaps 28 extending transversely from the lower portion of the side panels 12. The height of the closure flaps is sufficient to cover the pricing code on the adjacent end cans. The bottom edge of the portion of the end closure flaps which contact the cans terminates at the bottom of the cylindrical portion of the cans, not extending down over the inwardly tapered bottom portion of the cans. This arrangement leaves a gap in this area between the end closure flaps and the bottom panel substantially equal in height to the height of the tapered bottom portion of the cans. The closure flaps overlie, and are connected to, end panel flaps 30 which extend up from the bottom panel. Partial end panels are thus formed by the end closure flaps 28 and the end panel flaps 30. These partial end panels not only cover the pricing code on the cans but also snugly fit around the adjacent curved surface of the end cans to hold the cans in place.

Assisting to hold the end cans in place are upper corner webs 32, which extend from the end of the top panel 16 to the inner surface of the side panels. As best shown at the left end portion of the carrier in FIG. 1, the corner webs are connected at one end to the top panel by fold lines 34 and at the other end to a corner closure flap 36 by fold lines 38. The corner closure flap 36 is connected to the side panels just above the end closure flaps 28 along fold lines 40.

Although the corner webs are preferred as a means of additionally securing the package against movement of the packaged cans or other articles out the end of the carrier, the tightly wrapped carrier and the partial end panels may be sufficient to adequately provide this function. The corner webs, however, serve an additional function. As the partially formed carrier blank is traveling through the packaging machine the corner webs prevent the closure flaps from flapping and interfering with the operation of various elements of the packaging machine.

Figure 3:
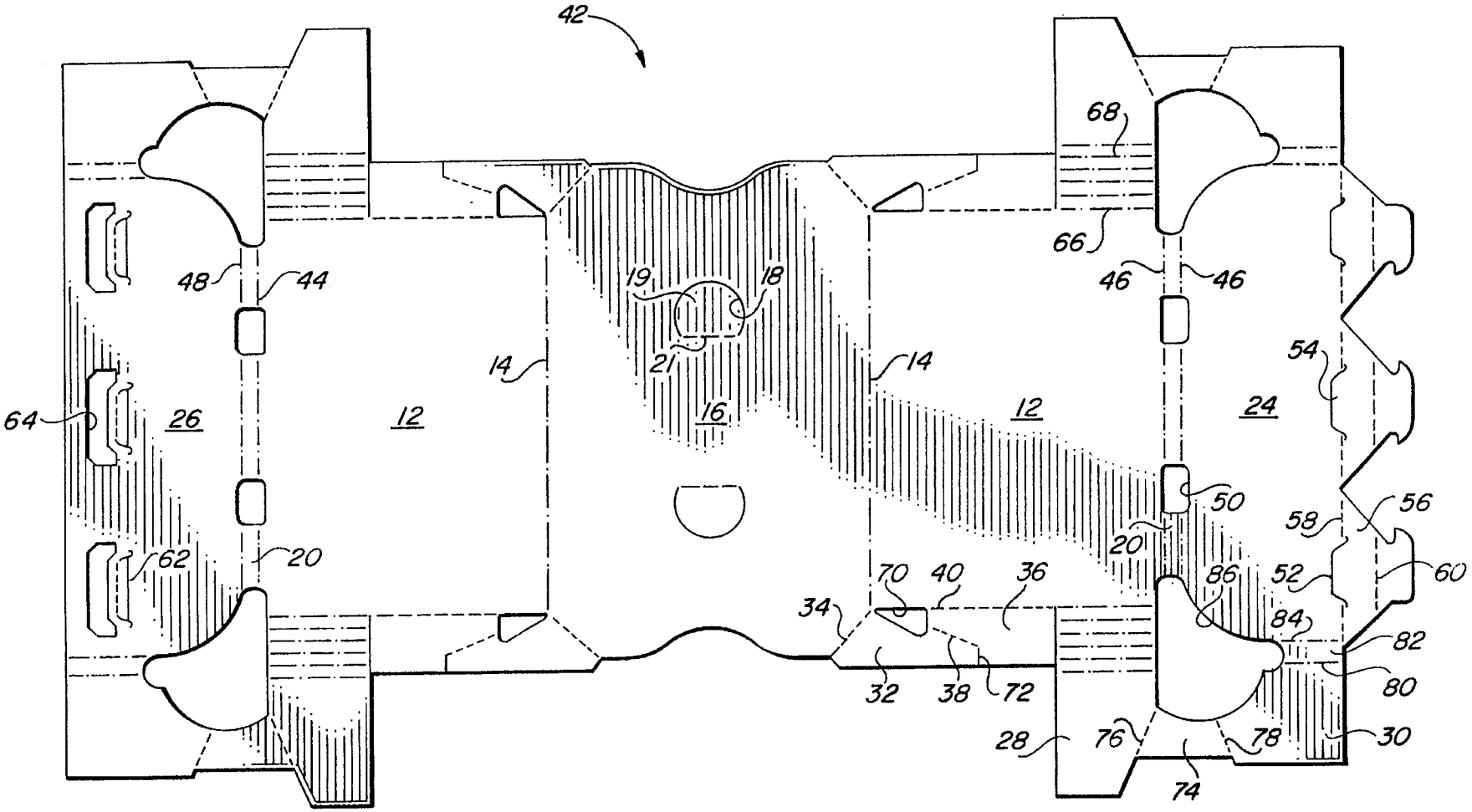
FIG. 3 is a plan view of a blank for forming the carrier of FIG. 1.

A blank 42 for forming the carrier is shown in FIG. 3, wherein like reference numerals to those used in FIGS. 1 and 2 refer to like elements. It can be seen that the blank is substantially rectangular in shape except for the outwardly extending end flaps 28 and end panel flaps 30. Centrally located in the blank is top panel section 16, with side panel sections 12 connected at either side. Bevel panel sections 20 are connected to the side panel sections along fold lines 44 and to the bottom panel flaps 24 and 26, respectively, by fold lines 46 and 48. Cutouts 50 may be provided in the bevel panels to facilitate folding of the bevel panels. The bottom panel flap 24 includes slits 52, which define primary locking tabs 54. Secondary locking tabs 56 are connected to the bottom panel flap 24 by fold line 58. The secondary tabs include fold lines 60 which facilitate insertion of the tabs through slits 62 in the bottom panel flap 26. The bottom panel flap 26 also includes locking openings 64 for receiving the primary locking tabs 54.

Still referring to FIG. 3, each end closure flap 28 is connected to the associated side panel section 12 by a score line 66 and each corner closure flap 36 is connected to the associated side panel section by the fold line 40. The fold lines 40 allow the corner closure flaps 36 to easily pivot into position, while the score lines 66 enable the end closure flaps 28 to begin a smooth transition about the curved surface of an adjacent can C. A series of parallel score lines 68 permit the end closure flaps to readily follow the contour of the adjacent cans. The fold lines 34 and 14 intersect at a corner of a triangular cutout 70, one edge of which is aligned with the fold line 40. The fold line 38 extends between the cutout 70 and the interior end of a slit 72, the fold line 38 and slit 72 separating the corner webs 32 from the corner closure flaps 36.

A gusset panel 74 is connected at one end to each end closure flap 28 by fold line 76 and at the other end to the associated end panel flap 30 by fold line 78. Each end panel flap 30 is also connected by fold line 80 to a bevel panel 82, which in turn is connected by fold line 84 to the adjacent bottom panel flap 24 or 26. Cutouts 86, formed by edges of the end closure flaps 28, the gusset panels 74, the end panel flaps 30, the side panel sections 12, the bottom panel flaps 24 and 26 and the bevel panels 20 and 82, are also provided at each corner area of the blank.

To form a carrier from the blank the articles to be packaged are grouped together and the blank is positioned so that the top panel section of the blank overlies the tops of the articles. The side panel sections are then folded down about the fold lines 14 while at the same time folding the corner closure flaps in so that they contact the inner face of the side panel sections. Movement of the fold line 38 causes the corner webs 32 to pivot outwardly about the fold lines 38, causing the inner face of the portions of the corner webs adjacent the fold lines 38 to be inwardly directed toward the interior of the carrier and the outer face to be outwardly directed against the corner closure flaps. The force causing the corner webs 32 to pivot down about the fold lines 34 as a result of the side panel sections being folded down from the top panel section is significantly greater than the force tending to return the corner closure flap to its original condition, due in large part to the arrangement of the fold lines connecting these elements to the carrier. The corner web fold lines 34, which form an obtuse angle with the associated fold line 14, lie in a different plane and at a different angle than the corner web fold lines 38, which form an acute angle with the associated corner closure flap fold line 40. This relationship produces a biasing force after the corner closure flaps and the corner webs have been folded into place which tends to hold the corner webs in their operable position. Once the corner closure flaps 36 are folded inwardly, they thus remain inwardly folded even after the original folding force is removed. Downward folding of the side panel sections is continued until the side panel sections contact the cans, with the lower portions of the corner webs lying between the adjacent can and the connected corner closure flap. The cutout 70 shortens the fold line 38, thus reducing resistance to the bias holding the corner closure flap in closed position, and eliminates material which would otherwise tend to bunch together and interfere with the corner web folding operation.

Figure 4:
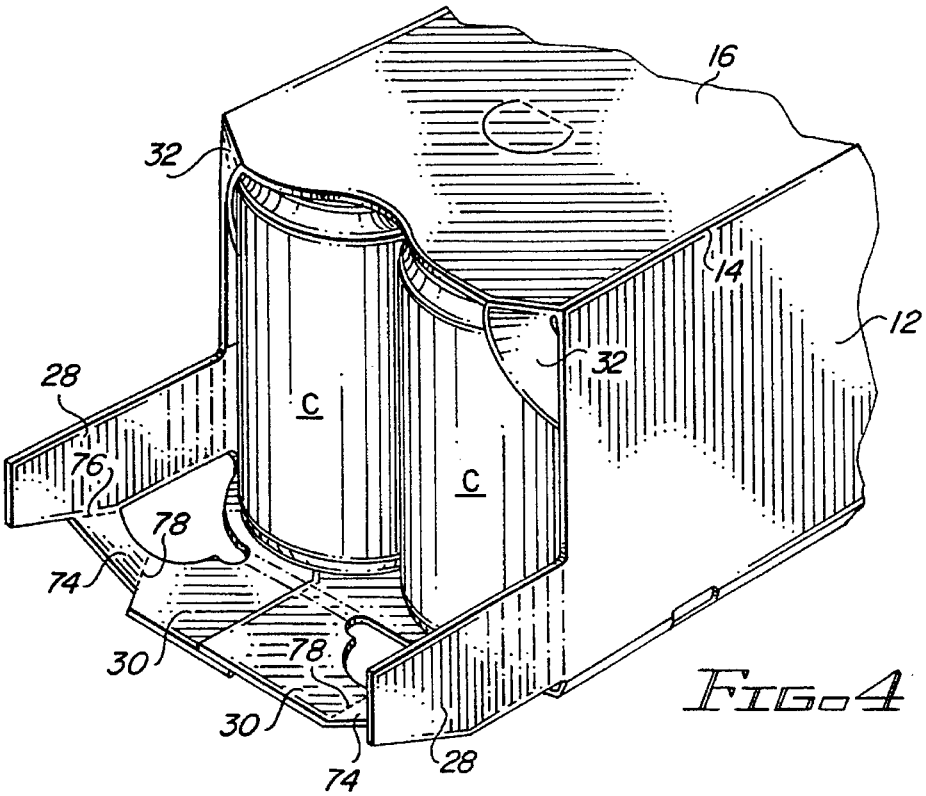
FIG. 4 is a pictorial view of the carrier at an interim stage of fabrication.

The bottom panel is then formed by overlapping the bottom panel flaps 24 and 26 and connecting them to each other. This is carried out in the illustrated arrangement by inserting the primary locking tabs 54 into the locking openings 64 and the secondary locking tabs 56 into the slits 62. It will be appreciated that for the purpose of this invention the various locking tabs and openings could be dispensed with and the bottom panel flaps could be adhered together by glue, since the formation of the end panels is not dependent upon the specific means for connecting the bottom panel flaps. After the bottom panel has been formed the end closure flaps 28 extend out from the side panels 12 and the end panel flaps 30, which will have been overlapped as a result of the bottom panel flaps being overlapped, extend out from the bottom panel. The carrier at this stage of fabrication is shown in FIG. 4. It can be seen that the folding of the bottom panel flaps cause the gusset panels 74 to fold up out of the original plane of the blank.

Figure 5:
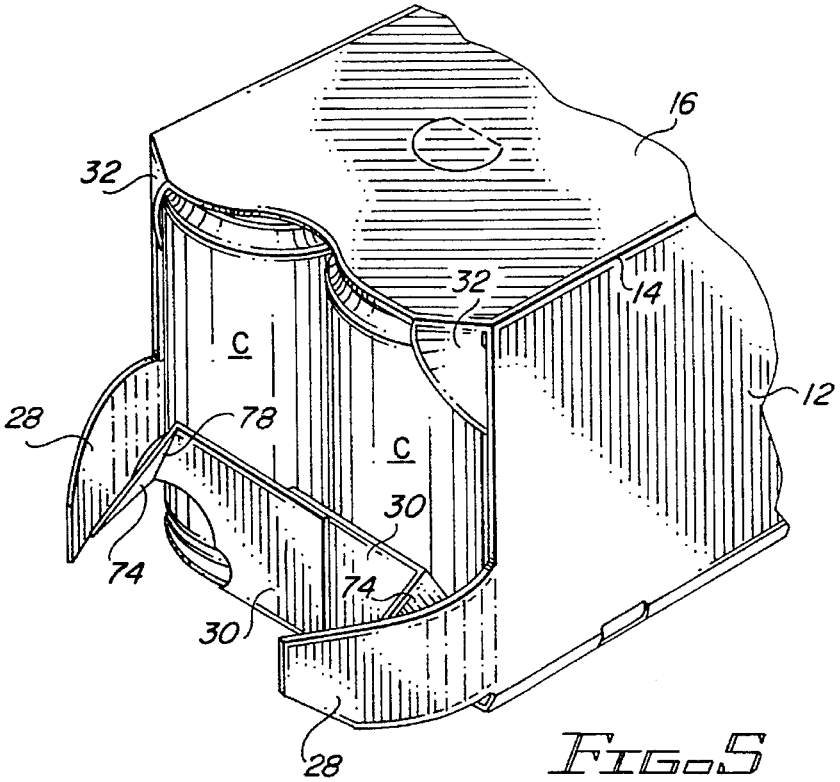
FIG. 5 is a pictorial view of the carrier at a later stage of fabrication.

The final step in forming the carrier is initiated by folding the end panel flaps 30 up about the bevel panel fold lines 84 to their final vertical position. The connected individual flaps at each end of the carrier function as a single end panel flap and are readily folded up into place. As the gusset panel fold lines 78 move up with the end panel flaps 30, the gusset panels 74 are pulled along, pivoting down about the fold lines 78 and up about the fold lines 76 to the position illustrated in FIG. 5. Glue is then applied to the end panel flaps and the end closure flaps are moved into place by bringing them around the adjacent cans and adhering them to the end panel flaps. This maneuver completes the folding of the gusset panels 74, bringing them to their final position between the end panel flaps and the end closure flaps. The carrier at this point is completely fabricated and appears as shown in FIG. 1.

By providing the cutouts 86, the gusset panel fold lines 76 and 78 are shortened with respect to the height that the end panel flaps and the end closure flaps extend, which reduces resistance to the end panel folding action described above. Also, as in the case of the cutouts 70, provision of the cutouts 86 reduces the amount of blank material at the corner areas, thereby eliminating material which otherwise would bunch together into unsightly bulges and wrinkles and interfere with the folding operation. The cutouts also make it possible to view the rounded corner edges of the bottom panel through the gap created by the cutouts beneath the end closure flaps. This presents a neat, clean appearance when packaging rounded articles such as beverage cans.

The invention provides partial end panels that are very strong, yet only need to extend as high as necessary in order to conceal the pricing code on individual packaged articles. The construction of the end closure flaps enables them to closely and snugly follow the contour of the end articles. Further, the gusset panel arrangement provides for an automatic initial closing movement of the end closure flaps which is initiated simply by folding the end panel flaps up into place. Although the use of corner webs is desirable to furnish additional resistance to outward movement of the upper portions of the articles, particularly in carrier designs such as the design depicted in the drawings where the end articles are put on display by locating them beyond the ends of the side panels, their use may not always be necessary, as in carrier designs where longer side panels are employed.

Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A wrap-around carrier containing a plurality of articles, comprising:

a top panel having opposite side edges;

opposite side panels foldably connected to the opposite side edges of the top panel;

a bottom panel connected to the side panels, the bottom panel having opposite end edges;

an end panel flap foldably connected to each end edge of the bottom panel;

an end closure flap extending from opposite ends of each side panel, the end closure flaps overlying portions of associated end panel flaps; and each end closure flap being connected to an associated end panel flap by a gusset panel lying between the end closure flap and the associated end panel flap in substantially face-to-face contact therewith.

2. A wrap-around carrier as defined in claim 1, wherein the gusset panels are connected to associated end panel flaps and associated end closure flaps by fold lines which are relatively short compared to the height of the end panel flaps and the end closure flaps.

3. A wrap-around carrier as defined in claim 1, wherein the bottom panel is comprised of two connected bottom panel flaps, each bottom panel flap being foldably connected to a side panel.

4. A wrap-around carrier as defined in claim 3, wherein each end panel flap is comprised of separate flaps foldably connected to each of the bottom panel flaps.

5. A wrap-around carrier as defined in claim 4, wherein the separate flaps comprising each end panel flap are in overlapped relationship.

6. A wrap-around carrier as defined in claim 1, wherein the articles have curved outer surfaces, the end closure flaps contacting and extending around adjacent portions of the curved outer surfaces of the articles.

7. A wrap-around carrier as defined in claim 1, wherein the top panel includes end edges, the carrier including four corner webs, each corner web extending from an associated end edge of the top panel to an associated side panel.

8. A wrap-around carrier as defined in claim 7, wherein each corner web is connected to the associated end edge of the top panel by a fold line, each corner web also being connected by a fold line to a corner closure flap, the corner closure flap being connected by a fold line to an adjacent end edge of an associated side panel.

9. A wrap-around carrier as defined in claim 8, wherein the fold line connecting a corner web to an associated end edge of the top panel extends at an obtuse angle to the foldable connection between the top panel and the associated side panel.

10. A wrap-around carrier as defined in claim 9, wherein the fold line connecting a corner web to an associated corner closure flap extends at an acute angle to the fold line connecting the associated corner closure flap to the associated side panel.

11. A wrap-around carrier containing a plurality of substantially cylindrical cans, comprising:

a top panel having opposite side edges;

opposite side panels foldably connected to the opposite side edges of the top panel;

a bottom panel flap foldably connected to each of the side panels, the bottom panel flaps being connected together to form a bottom panel;

each bottom panel flap having opposite end edges to which opposite end panel flaps are foldably connected;

an end panel flap connected by a fold line to each end edge of each of the bottom panel flaps and extending substantially vertically for a relatively short distance compared to the height of the carrier;

an end closure flap extending from opposite ends of each side panel, the end closure flaps overlying portions of associated end panel flaps; and each end closure flap being connected to an associated end panel flap by a gusset panel lying between the end closure flap and the associated end panel flap in substantially face-to-face contact therewith, each end closure flap contacting and extending around adjacent portions of the cylindrical surface of an adjacent can.

12. A blank for forming a wrap-around carrier for holding a plurality of articles, comprising;

a centrally located top panel section;

a side panel section on either side of the top panel section connected thereto by a fold line;

a bottom panel flap connected by a fold line to each side panel section, the bottom panel flaps having opposite end edges;

an end panel flap foldably connected to each end edge of each of the bottom panel flaps;

an end closure flap extending from opposite ends of each side panel section, and connected thereto by a score line, each end closure flap including a plurality of parallel spaced apart score lines, each of said score lines being parallel to said score line connecting said end closure flap to said side panel section, each end closure flap being associated with one of the end panel flaps; and each end closure flap being connected by a fold line to a gusset panel, the gusset panel being connected by a fold line to an associated end panel flap;

the bottom panel flaps together forming the bottom panel of a carrier formed from the blank, the end panel flaps together forming a portion of partial end panels in such a carrier and the end closure flaps being connected to the end panel flaps in such a carrier.

13. A blank for forming a wrap-around carrier as defined in claim 12, wherein the fold line connecting an end closure flap to an associated gusset panel and the fold line connecting the associated gusset panel to an associated end panel flap extending toward each other so as to form an acute angle therebetween.

14. A blank for forming a wrap-around carrier as defined in claim 12, wherein the top panel section includes end edges, the blank including four corner webs, each corner web extending from an associated end edge of the top panel to an associated corner closure flap.

15. A blank for forming a wrap-around carrier as defined in claim 14, wherein each corner web is connected to the associated end edge of the top panel section by a fold line, each corner web also being connected by a fold line to the associated corner closure flap, the corner closure flap being connected by a fold line to an adjacent end edge of an associated side panel.

16. A blank for forming a wrap-around carrier as defined in claim 15, wherein each corner closure flap lies between an associated corner web and an associated end closure flap.

* * * * *